US006045014A

United States Patent [19]

Marino

[11] Patent Number: 6,045,014

[45] Date of Patent: Apr. 4, 2000

[54] DISPENSING POUR SPOUT CLOSURE

[76] Inventor: Michael Marino, Rte. 422 W., R.R. 2, Box 2801, New Castle, Pa. 16101

[21] Appl. No.: 09/290,915

[22] Filed: Apr. 12, 1999

[51] Int. Cl.[7] ..... B67D 3/00

[52] U.S. Cl. ..... 222/546; 222/571

[58] Field of Search ..... 222/546, 556, 222/568, 571

[56] References Cited

U.S. PATENT DOCUMENTS

| | | | |
|---|---|---|---|
| 3,240,405 | 3/1966 | Abbott . | |
| 3,877,598 | 4/1975 | Hazard . | |
| 4,010,875 | 3/1977 | Babiol . | |
| 4,244,495 | 1/1981 | Lorscheid et al. . | |
| 4,377,247 | 3/1983 | Hazard et al. . | |
| 4,711,363 | 12/1987 | Marino . | |
| 4,948,003 | 8/1990 | Munoz . | |
| 5,251,793 | 10/1993 | Bolen, Jr. et al. | 222/556 |
| 5,400,912 | 3/1995 | Brown et al. . | |
| 5,497,906 | 3/1996 | Dubach | 222/546 |
| 5,865,353 | 2/1999 | Baudin | 222/546 |

*Primary Examiner*—Philippe Derakshani
*Attorney, Agent, or Firm*—Harpman & Harpman

[57] ABSTRACT

A pour spout closure for use on containers comprising, a cap configuration having a pour spout and a return reservoir integrally joined to a closure by a live hinge. A secondary cap is formed on the closure that is registerable in the return reservoir when the closure is in closed position holding the secondary cap and closure in closed position.

10 Claims, 3 Drawing Sheets

DISPENSING POUR SPOUT CLOSURE

BACKGROUND OF THE INVENTION

1. Technical Field

This invention relates to closures for containers having pour spout return reservoirs for dispensing products from within the containers.

2. Description of Prior Art

Prior art devices of this type have relied on a variety of different cap closure combinations utilizing a "live" hinge to interconnect the closure to the cap, see for example U.S. Pat. Nos. 3,240,405, 3,877,598, 4,010,875, 4,244,495, 4,377,247, 4,711,363, 4,948,003 and 5,400,912.

In U.S. Pat. No. 3,240,405 a dispensing closure is disclosed having a threaded base cap and a hinge closure extending therefrom. A central nozzle and sealing ridge extends from the cap and are registerable with a conical plug and collar portion on the closure.

U.S. Pat. No. 3,877,598 is directed to a closure having a child-safety feature wherein pressure must be applied to the cap in closed position to tilt and remove the closure from sealing relation with the cap base.

U.S. Pat. No. 4,010,875 claims a pourer-stopper having a cap spout and an integral hinge closure with a sealing collar engageable thereon.

U.S. Pat. No. 4,244,495 details a safety closure assembly for containers comprising a lid and a lid carrier integrally hinged together. The closure lid has a cam adjacent the hinge to transversely deform a resilient tongue on the cap to produce a snap-up effect.

U.S. Pat. No. 4,377,247 shows a dispensing closure with a living hinge that moves the closure to an open or closed position by deformation of the hinge by the user.

U.S. Pat. No. 4,711,363 discloses applicant's own earlier tamper evident closure having a container engagement cap portion and an integral closure cap portion with a locking return pin and tubular plug for the respective registration on the cap portion.

U.S. Pat. No. 4,948,003 has a container and closure with an internal tamper indication feature. A base cap has an upstanding pour spout with an internal pull tab. A hinge closure has an integral collar that is registerable over and around the pour spout.

In U.S. Pat. No. 5,400,912 a closure with concealed hinge is illustrated for use with a dispenser spout with a closure lid on a concealed hinge extending therefrom.

SUMMARY OF THE INVENTION

A one-piece molded pour spout cap and hinge closure for use on a container. The pour spout cap has a product return well thereabout for registration with a sealing engagement collar on the hinge closure. A secondary sealing flange is positioned on the pour spout cap for sealing relation with a container.

DESCRIPTION OF THE PREFERRED EMBODIMENT

Figure 1:
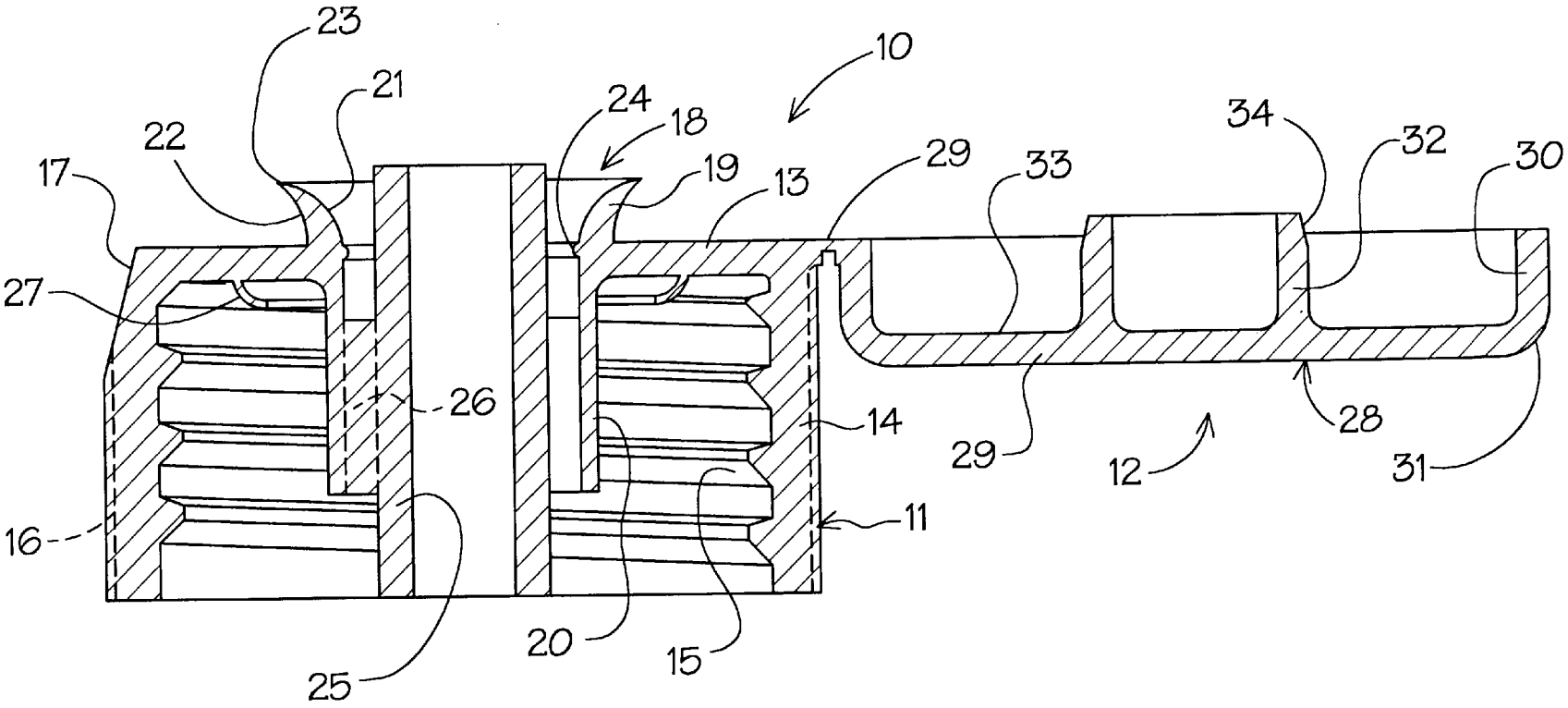
FIG. 1 is a sectional view on lines 1—1 of FIG. 2.
Figure 2:
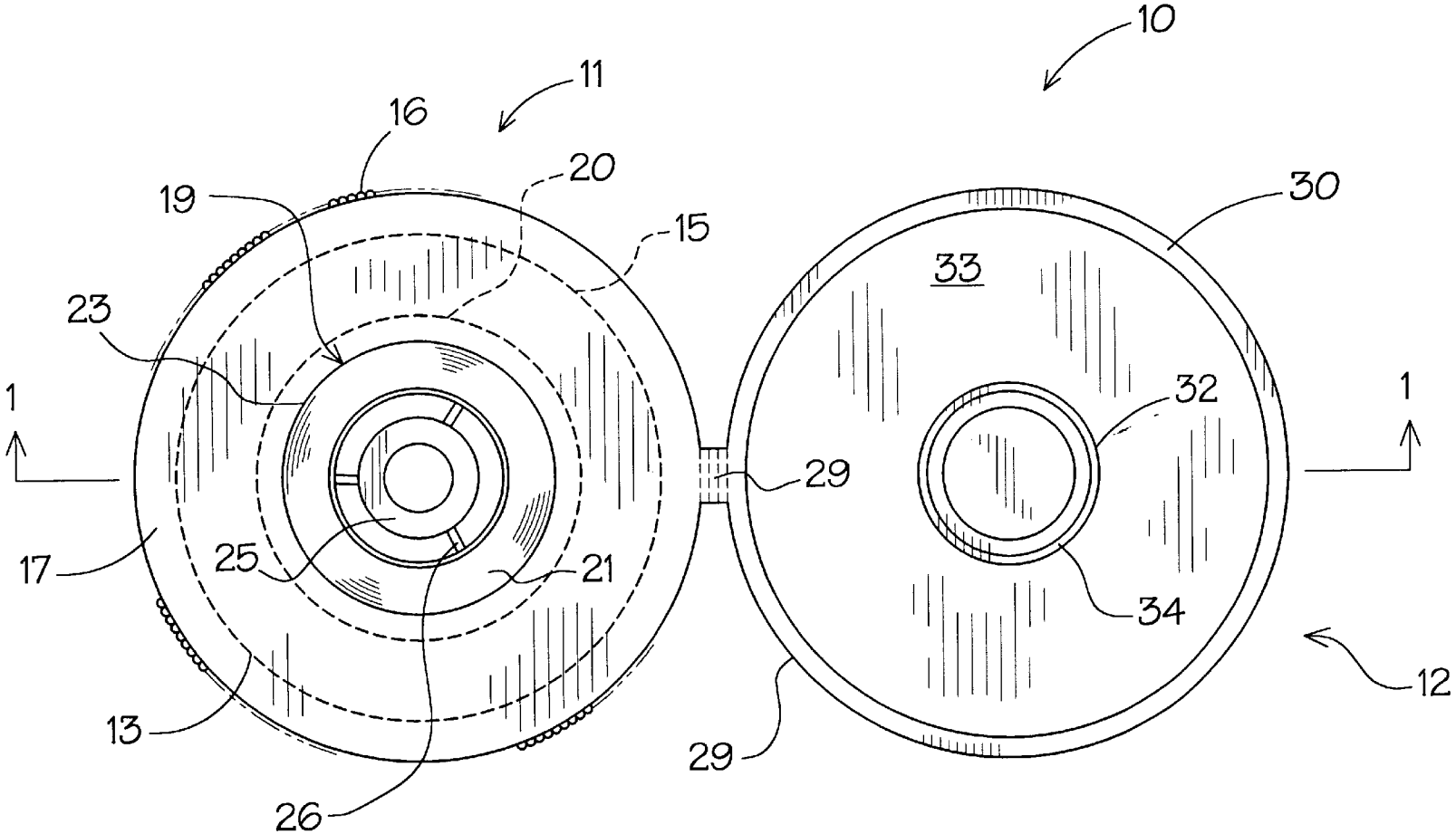
FIG. 2 is a top plan view of the closure with the cap in open position.
Figure 3:
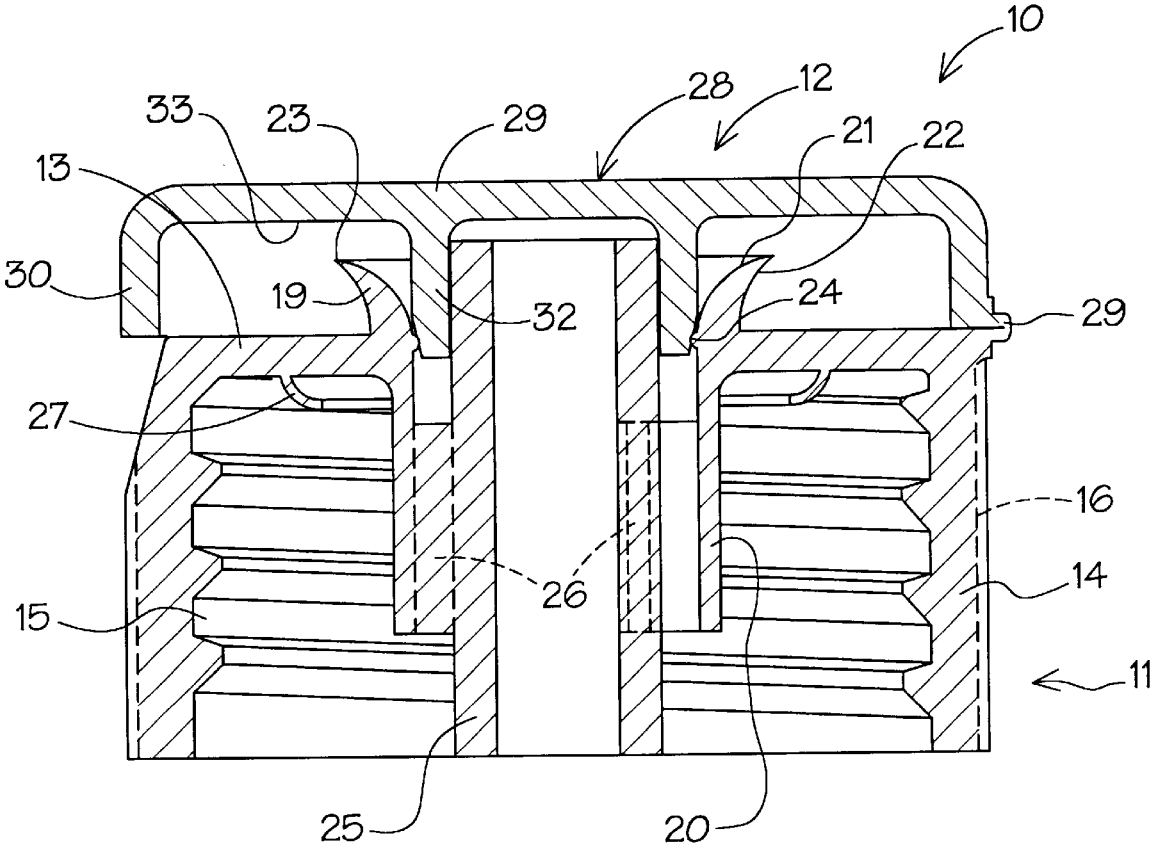
FIG. 3 is a sectional elevational view of the dispenser closure of the invention in closed position.

Referring to FIGS. 1–3 of the drawings, a pour spout closure 10 can be seen having a container engagement cap

11 and a hinge closure portion 12. The container engagement cap 11 has a top portion 13 with a depending annular sidewall 14 with a continuous thread pattern 15 formed therein. The sidewall 14 has a gnarled outer surface at 16 and a angled access portion 17 thereon extending from the top portion 13. A contents return well 18 extends from the center of the top portion 13 defined by an upstanding collar 19 with an integral depending annular flange 20 extending therefrom. The collar 19 has a conical inner wall surface at 21 and a contoured outer wall surface at 22 which together terminate as an annular edge at 23, best seen in FIGS. 1–3 of the drawings.

An annular engagement bead 24 extends from the inner wall surface 21 and defines a transition point between the collar 19 and depending annular flange 20 in planar relation with the top portion 13. A pour spout 25 is positioned within the top portion 13 in annularly spaced relation to the collar 19 and associated depending annular flange 20 by a plurality of circumferentially spaced radially extending support legs 26.

The support legs 26 extend inwardly from the depending annular flange 20 and are in spaced relation to the top portion 13.

The pour spout 25 and the depending annular flange 20 define multiple openings in the top 13 about the pour spout 25 within the upstanding collar 19 as best seen in FIG. 2 of the drawings.

Referring back to FIGS. 1 and 3 of the drawings, a resilient annular sealing flange 27 can be seen that depends downwardly and inwardly from the top portion 13 in annularly spaced relation from the depending annular flange 20 as hereinbefore described. The sealing flange 27 provides a secondary seal on a container (not shown).

The hinge closure portion 12 has a main body member 28 interconnected to the container engagement portion 11 by a living hinge 29 extending from the engagement cap 11 opposite the access area 17. The main body member 28 has an upper cap wall 29 with an annular depending skirt 30 extending from a perimeter edge 31 thereof. An internal collar 32 extends from the inside surface 33 of the upper cap wall 29. The collar 32 is generally cylindrical and is of a dimensional characteristic so as to be registerably engaged between the collar 19 and pour spout 25 respectively. The internal collar 32 has an annularly tapered outer surface 34 extending inwardly from its free end to facilitate the initial insertion around the pour spout and to be progressively engaged by the sealing bead 24 in closing as best seen in FIG. 3 of the drawings.

As demonstrated, the internal collar 32 is dimensionally longer than that of the skirt 30 and the pour spout 25 is dimensionally greater than that of the surrounding collar 32.

The internal collar 32 and the pour spout 25 being dimensionally longer than the skirt 30 and collar 19 allow for an effective closing interface area therebetween to provide an internal void free seal as best seen in FIG. 3 of the drawings.

The closure interface as hereinbefore described effectively seals the openings which are formed above the respective support lugs 26.

In operation, to "open" the pour spout closure of the invention, pressure is applied against the skirt 30 of the closure portion 12 at the access area 17 by the user as best seen in FIG. 3 of the drawings lifting and hinging back the closure portion 12 and un-sealing the interengaging internal collar 32 from within the upstanding collar 19 to an open position illustrated in FIG. 2 of the drawings.

It will be evident from the above description that in use while pouring material from the container (not shown) the pour spout 25 will direct the flow of material from within and any excess or errant material will be caught as will occur during the completion of the pour within the return well 18 defined by the upstanding collar 19 and passed back through into the container (not shown) vis-a-vis the openings defined between the depending flange portion 20 and the exterior of the pour spout 25 by the interconnecting legs 26 as hereinbefore described.

It will thus be seen that a new and novel dispensing pour spout closure has been illustrated and described and that various changes and modifications may be made thereto without departing from the spirit of the invention.

Therefore I claim:

1. A dispensing pour spout closure comprising, a top portion, an annular depending flange extending therefrom, means thereon for attachment to a container, a spout within an apertured return well in said top portion, said return well comprising an upstanding annular collar with a depending annular flange, a closure portion hinged to said top portion by a connecting hinge, said closure portion comprising a cap wall with an annular depending skirt, an internal sealing collar extending from said cap wall in a position to cooperate with said pour spout and said upstanding collar, means for sealing said dispensing spout and said return well and effect a seal therewith when said closure portion is in closed position on said top portion, sealing means on said top portion for said container, means for positioning said dispensing spout within said return well and means for releasing said closure portion from within said top portion.

2. The dispensing pour spout closure set forth in claim 1 wherein said means for attachment on said annular depending flange comprises, a continuous internal thread pattern.

3. The dispensing pour spout closure set forth in claim 1 wherein said means for sealing said depending spout and said return well comprises, an annular bead on the inner wall surface of said upstanding collar, engageable on said internal sealing collar.

4. The dispensing pour spout set forth in claim 1 wherein said sealing means on said top portion for engagement with said container comprises, a annular depending resilient flange on said top portion.

5. The dispensing pour spout closure set forth in claim 1 wherein said means for positioning said dispensing spout within said return well comprises, a plurality of annularly spaced support legs extending from said depending annular collar flange.

6. The dispensing pour spout set forth in claim 1 wherein said means for releasing said closure portion from said top portion comprises, an angled access portion on said depending annular sidewall of said top portion.

7. The dispensing pour spout closure set forth in claim 6 wherein said angled access portion is positioned in oppositely disposed relation to said connecting hinge.

8. The dispensing pour spout set forth in claim 1 wherein said upstanding annular collar within said return well has conical inner and outer wall surfaces.

9. The dispensing pour spout set forth in claim 1 wherein said upstanding annular collar within said return well is of a known vertical height, said pour spout is of a vertical height greater than that of said upstanding annular collar's known height.

10. The dispensing pour spout closure set forth in claim 1 is preferably made of molded synthetic resin material.

* * * * *